US007261019B1

(12) United States Patent
Lin

(10) Patent No.: US 7,261,019 B1
(45) Date of Patent: Aug. 28, 2007

(54) RETURNING ASSEMBLY OF SPANNER

(76) Inventor: Tsung-Da Lin, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/401,432

(22) Filed: Jul. 17, 2006

(51) Int. Cl.
*B25B 13/00* (2006.01)

(52) U.S. Cl. ..... 81/59.1; 81/60

(58) Field of Classification Search ..... 81/58, 81/58.1, 59.1, 60, 61, 62, 63, 63.1, 63.2
See application file for complete search history.

(56) References Cited

U.S. PATENT DOCUMENTS 6,067,881 A * 5/2000 Albertson ..... 81/59.1
6,807,881 B2 * 10/2004 Wu ..... 81/59.1
* cited by examiner

*Primary Examiner*—Jacob K. Ackun, Jr.

(57) ABSTRACT

A returning assembly of a spanner includes a driving portion having a receiving space, a switch unit and an ejecting unit having a truncated conic shape; a radial direction of the driving head having a slightly inclined buckling surface; the buckling surface and an inner wall of the receiving space being formed with a semilunar buckling space for receiving the ejecting unit; the ejecting unit serving for controlling the returning directions of the driving head. The driving head has a driving block which are arranged at an axial direction of the driving head for installing a socket or other driving assembly. A switch unit is installed in the driving head. The switch unit has a control end projected from the driving portion and a resisting end. The ejecting unit having a receiving chamber for receiving a resisting unit for firmly securing the ejecting unit in the buckling space.

8 Claims, 10 Drawing Sheets

RETURNING ASSEMBLY OF SPANNER

FIELD OF THE INVENTION

The present invention relates to spanners, and in particular to a returning assembly of a spanner, wherein an ejecting unit has a truncated conic shape so as to provide a preferred positioning effect to the spanner and thus the lifetime of the returning assembly is prolonged. The ejecting unit has a receiving chamber for receiving a resisting unit for firmly securing the ejecting unit in the buckling space.

BACKGROUND OF THE INVENTION

Spanners with returning functions are more and more popular currently. Furthermore, ratchetless spanners with returning functions have the advantages of lower noise and easy operation and thus they are the main trend in hand tools.

Current ratchetless spanner has a round cylinder as an ejecting unit in returning operation. The cylinder may cause the driving head to resist against an inner wall of a driving portion. However in this prior art, the round cylinder has an equal diameter in the longitudinal direction. No variation is in the radial direction and thus the positioning of the round cylinder is bad. It easily shifts and thus the positioning effect is not preferred.

Furthermore, since the round cylinder has an equal diameter, it cannot modify in wearing so that the cylinder will deform gradually in use. Thereby the returning function will lose due to the deformation of the round cylinder.

SUMMARY OF THE INVENTION

Accordingly, the primary object of the present invention is to provide a returning assembly of a spanner, wherein an ejecting unit has a truncated conic shape so as to provide a preferred positioning effect to the spanner and thus the lifetime of the returning assembly is prolonged.

To achieve above objects, the present invention provides a returning assembly of a spanner. The returning assembly includes a driving portion having a receiving space for receiving a driving head, a switch unit and an ejecting unit having a truncated conic shape; a radial direction of the driving head having a slightly inclined buckling surface; the buckling surface and an inner wall of the receiving space being formed with a semilunar buckling space for receiving the ejecting unit; the ejecting unit serving for controlling the returning directions of the driving head. A round cylindrical positioning portion is extended from the larger end of the truncated conic ejecting unit; and the buckling space has a shape corresponding to that of the ejecting unit. The driving head is formed of an outer cover and a ring which are received in the receiving space of the driving portion. The driving head has a driving block which are arranged at an axial direction of the driving head for installing a socket or other driving assembly. A switch unit is installed in the driving head; the switch unit has a control end projected from the driving portion and a resisting end in the driving portion. The action of the resisting end is controlled by the operation of the control end. The resisting end of the switch unit resists against the ejecting unit in the buckling space. The shift of the ejecting unit is controlled by the control end so as to operate the resisting end to control the returning operation of the driving head.

Moreover, the ejecting unit having a receiving chamber for receiving a resisting unit for firmly securing the ejecting unit in the buckling space.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
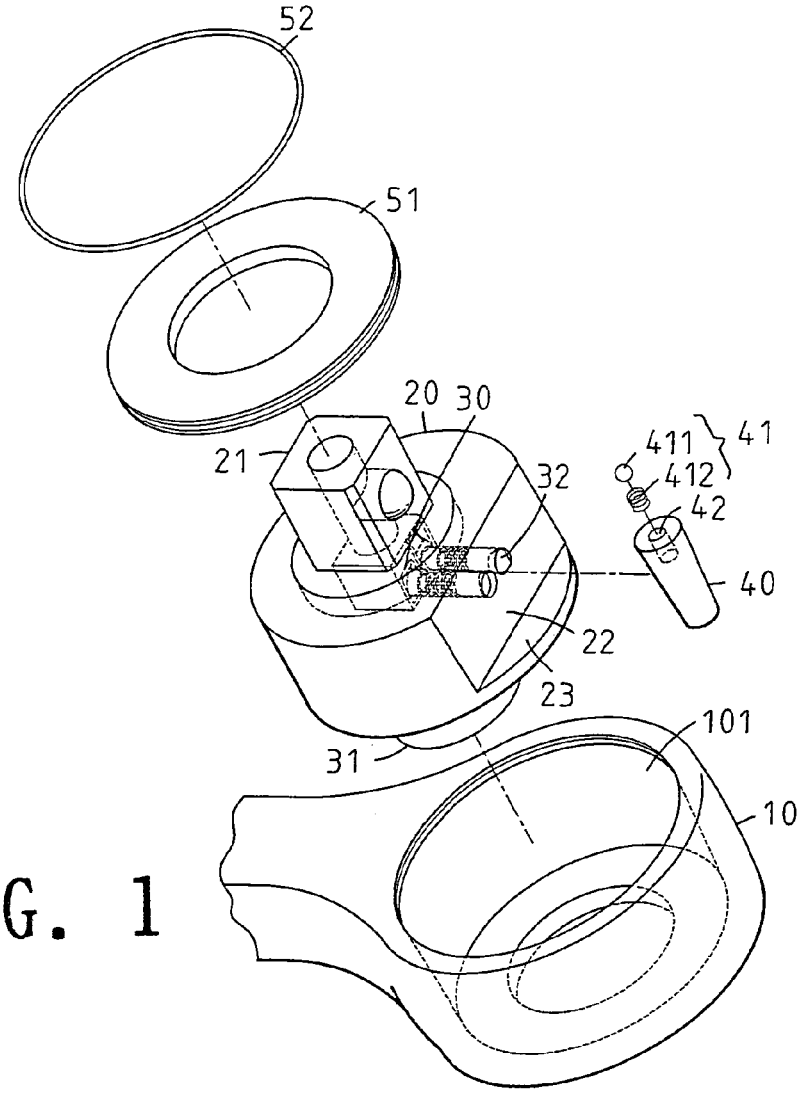
FIG. 1 is an exploded perspective view of the present invention.
Figure 2:
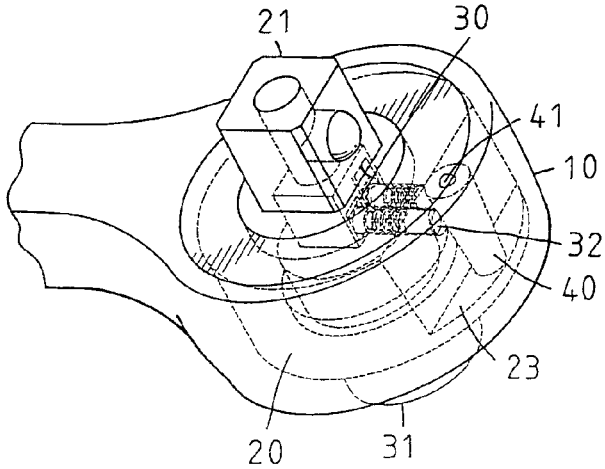
FIG. 2 is a perspective view of the present invention.

Referring to FIGS. 1 to 2, a returning assembly of a spanner of the present invention is illustrated. In the present invention, the ratchetless spanner is used as an example. The present invention has the following elements.

A driving portion 10 has a receiving space 101 for receiving a driving head 20, a switch unit 30 and an ejecting unit 40 having a truncated conic shape.

The driving head 20 is formed of an outer cover 51 and a ring 52 which are received in the receiving space 101 of the driving portion 10. The driving head 20 has a driving block 21 which are arranged at an axial direction of the driving head 20 for installing a socket or other driving assembly. A radial direction of the driving head 20 has a slightly inclined buckling surface 22. The buckling surface 22 and an inner wall of the receiving space 101 is formed with a semilunar buckling space 23 for receiving an ejecting unit 40. The ejecting unit 40 has an axial receiving chamber 42 for receiving a resisting unit 41. The receiving unit 41 is formed of a steel ball 411 and a spring 412. The switch unit 30 is installed in the driving head 20. The switch unit 30 has a control end 31 projected from the driving portion 10 and a resisting end 32 in the driving portion 10. The action of the resisting end 32 is controlled by the operation of the control end 31. The resisting end 32 of the switch unit 30 resists against the ejecting unit 40 in the buckling space 23. Thereby the user can shift the ejecting unit 40 by the control end 31 to operate the resisting end 32 so as to control the returning operation of the driving head 20. The assembly of the present invention is illustrated in FIG. 2. The operation and principle of the switch unit 30 is known in the prior art and the details will not be described herein.

Referring to FIGS. 3 to 7, one end of the ejecting unit 40 is enlarged and another end thereof has a small size so that the ejecting unit 40 has a truncated conic shape. The buckling space 23 is formed by the inclined buckling surface 22 and the inner wall of the receiving space 101 which is suitable for receiving the ejecting unit 40 having a truncated conic shape. The inner wall of the receiving space 101 and the buckling surface 22 are inclined surfaces. Thereby the ejecting unit 40 can be accurately positioned in a predetermined position in the buckling space 23. Furthermore, the contact surface of the ejecting unit 40 and the buckling space 23 are parallel so that the returning operation can be positioned accurately.

Figure 3:
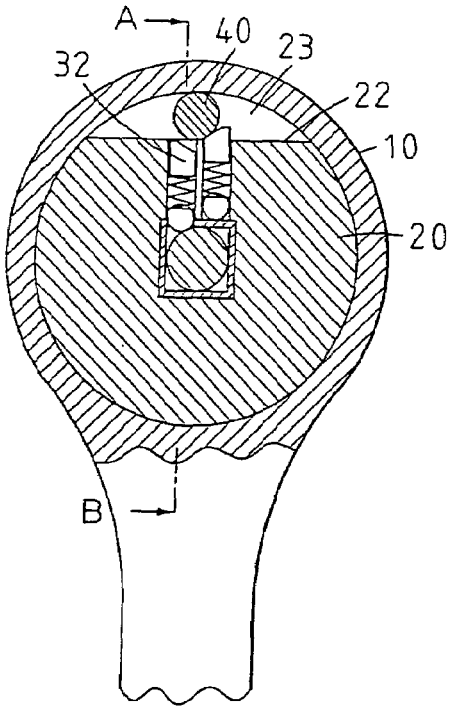
FIG. 3 is a cross sectional view showing the returning operation of the present invention.
Figure 4:
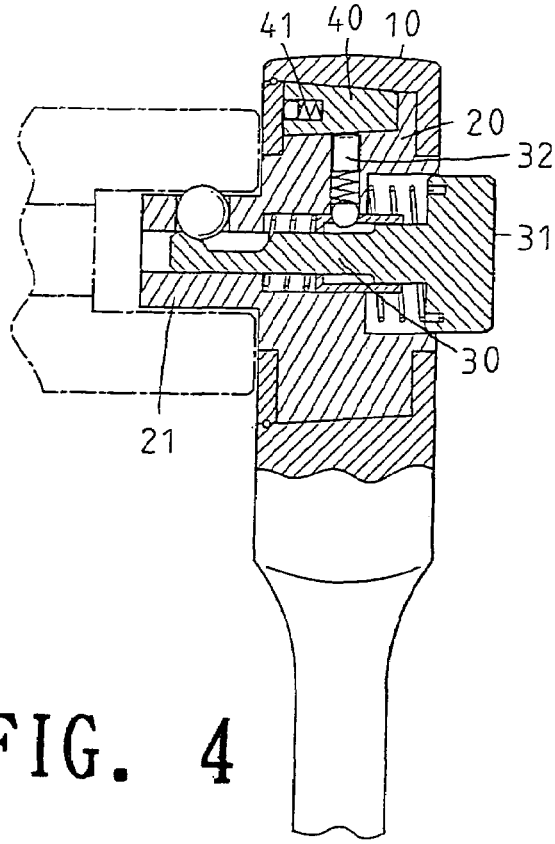
FIG. 4 is a cross sectional view along line AB in FIG. 3.

With reference to FIG. 3, when the ejecting unit 40 resists against the resisting end 32 of the switch unit 30, as the driving head 20 will rotate clockwise, it will resist against the ejecting unit 40 not to return to the original position. Thereby it can drive a screw means. When the driving head 20 rotates counterclockwise, the ejecting unit 40 will retract back to the center portion of the buckling space 23. Thereby it can return to the original position.

Figure 5:
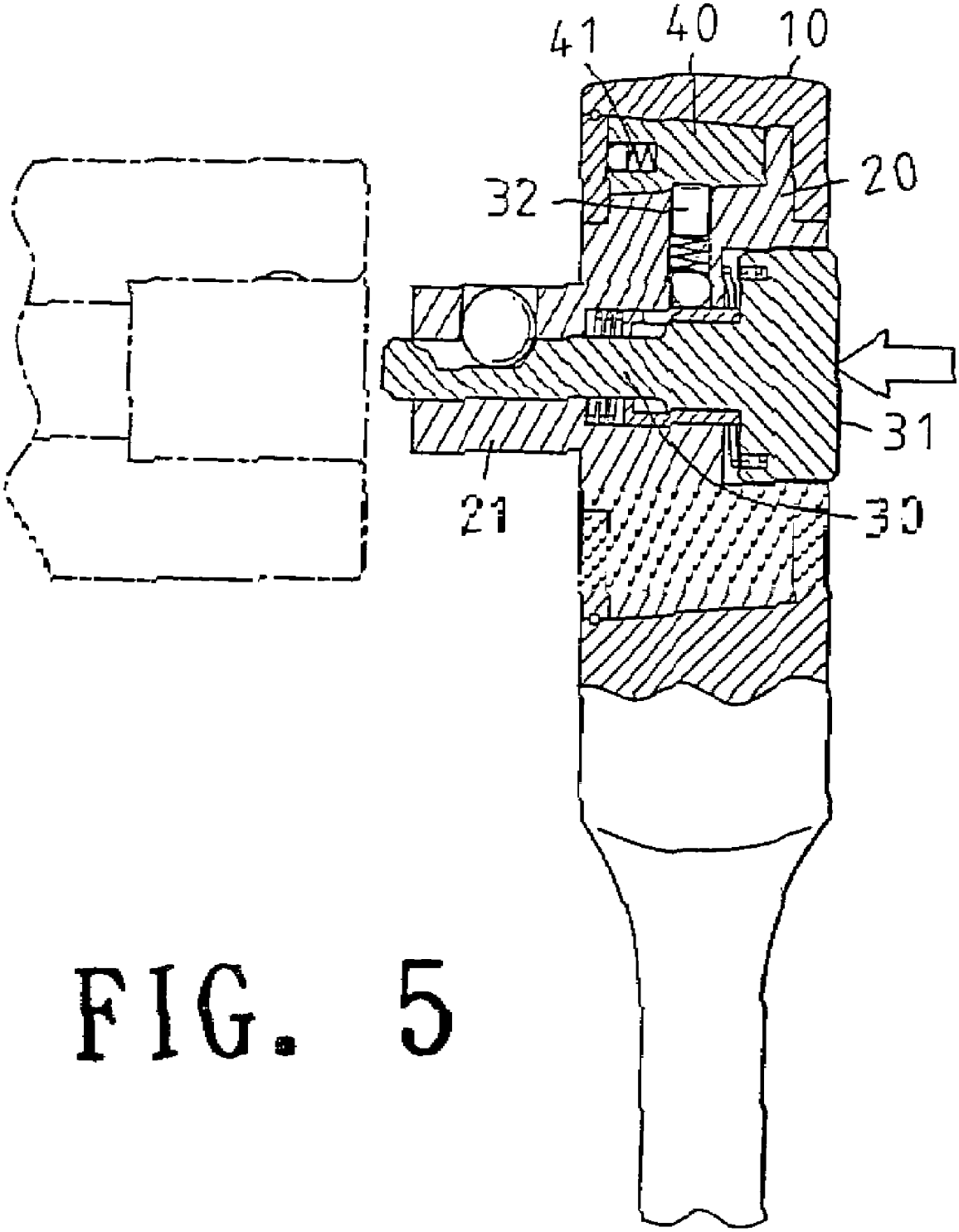
FIG. 5 is a schematic cross sectional view showing the switching operation of the present invention.

Referring to FIG. 5, when the user need change the returning direction, the user can press the control end 31 of the switch unit 30. Then the resisting end 32 of the switch unit 30 will change the shift direction of the ejecting unit 40.

Figure 6:
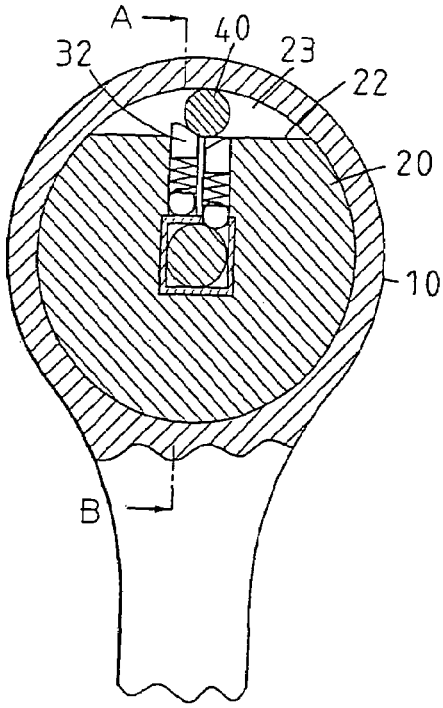
FIG. 6 is a cross sectional view about the returning operation of the present invention.
Figure 7:
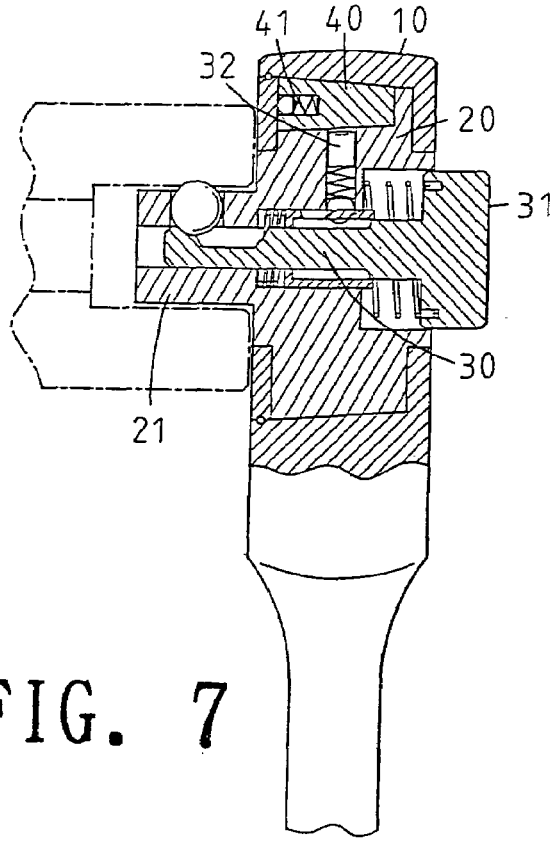
FIG. 7 is a cross sectional view along lie AB in FIG. 6.

With reference to FIG. 6, when the ejecting unit 40 is pushed by the resisting end 32 of the switch unit 30 to move rightwards to a narrow space in the buckling space 23, the driving head 20 will rotate counterclockwise to resist against the ejecting unit 40. Thereby the driving head 20 can be used to drive a screw unit. When the driving head 20 rotates clockwise, the ejecting unit 40 will retract back to the central portion of the buckling space 23. Thus the returning effect is achieved.

Figure 8:
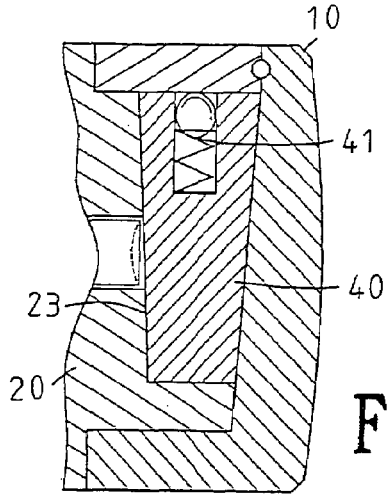
FIG. 8 is a cross section view showing the normal state of the ejection unit and buckling space of the present invention.
Figure 9:
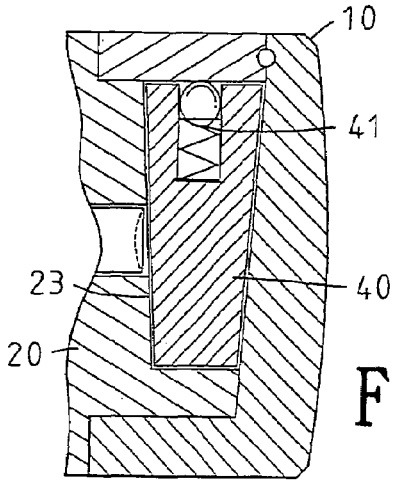
FIG. 9 is a schematic cross section view showing the wearing between the ejection unit and the buckling space so as to generate a gap therebetween.
Figure 10:
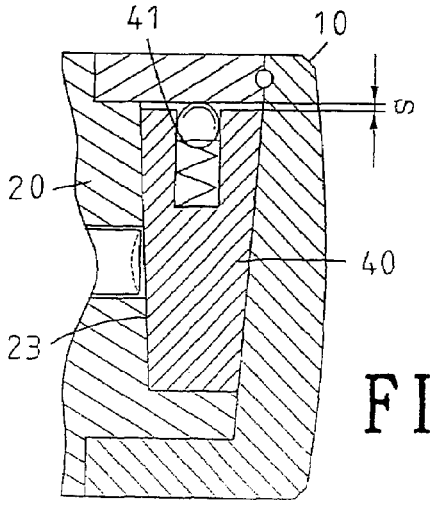
FIG. 10 is a cross section view of the ejection unit and the buckling space after correction.
Figure 11:
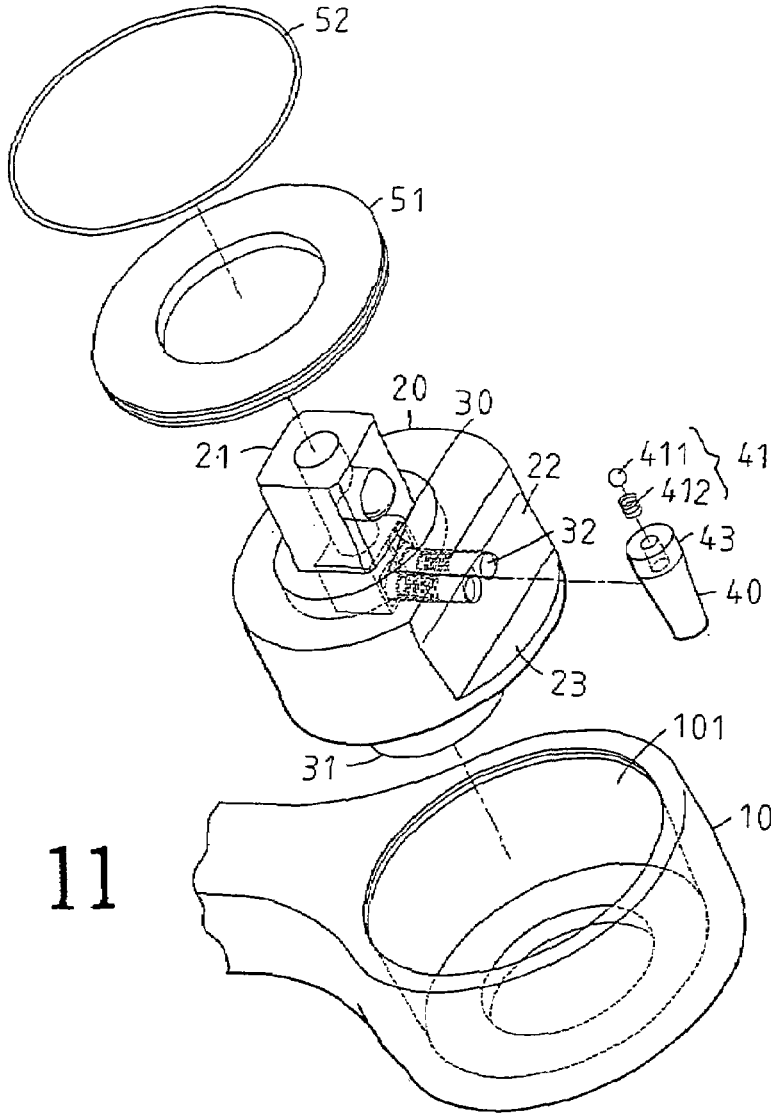
FIG. 11 is an exploded perspective view of the second embodiment of the present invention.
Figure 12:
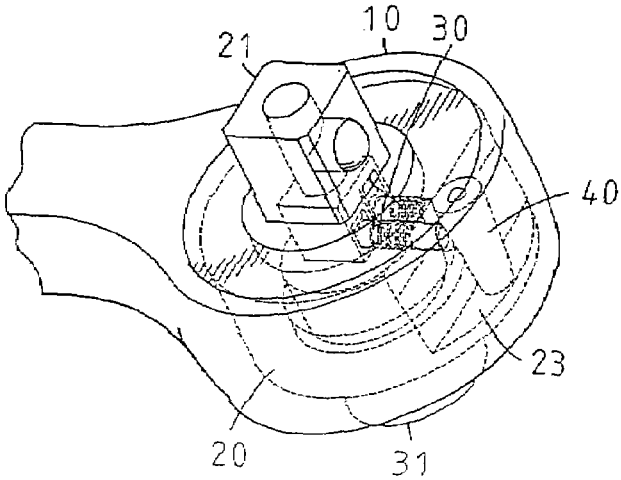
FIG. 12 is a perspective view of the second embodiment of the present invention.

Referring to FIGS. 8 to 10, in the present invention, the ejecting unit 40 has a truncated conic shape and the resisting unit 41 is axially installed in the ejecting unit 40 for increasing the positioning effect of the ejecting unit 40 so that the ejecting unit 40 will not wear in use.

Referring to FIG. 9, when the ejecting unit 40 and the buckling space 23 are worn due to long using time period and thus gaps are generated between the ejecting unit 40 and the buckling space 23. As shown in FIG. 10, the resisting unit 41 can push the ejecting unit 40 to a smaller diameter side of the buckling space 23 through a distance of S. Thus, the ejecting unit 40 may retain with a preferred tightness in the buckling space 23.

With reference to FIGS. 11 to 20, the second embodiment of the present invention is illustrated. Those identical to the first embodiment will not be described. Only those differences are described.

To have preferred positioning effect between the ejecting unit 40 and the buckling space 23, a round cylindrical positioning portion 43 is extended from the larger end of the truncated conic ejecting unit 40. The buckling space 23 has a shape corresponding to that of the ejecting unit 40 so that the contact surfaces of the ejecting unit 40 and the inner wall of the buckling space 23 are parallel. Thus the ejecting unit 40 can be well positioned.

Figure 13:
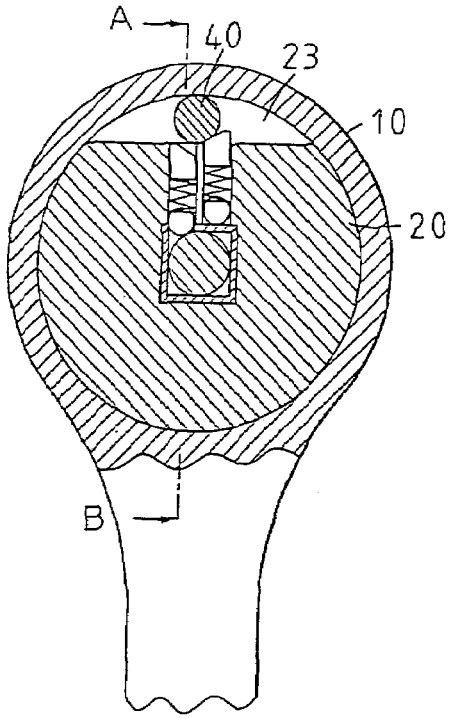
FIG. 13 is a cross sectional view showing the returning operation in the second embodiment of the present invention.
Figure 14:
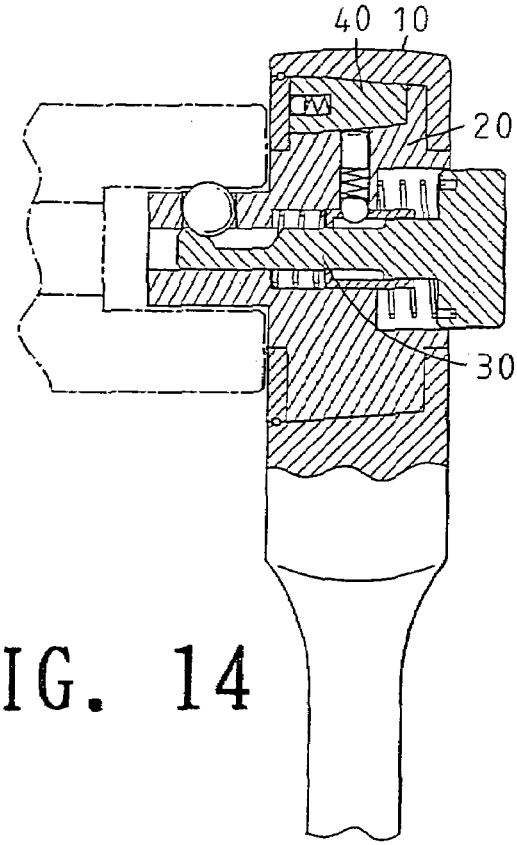
FIG. 14 is a cross sectional view along line AB in FIG. 3.
Figure 15:
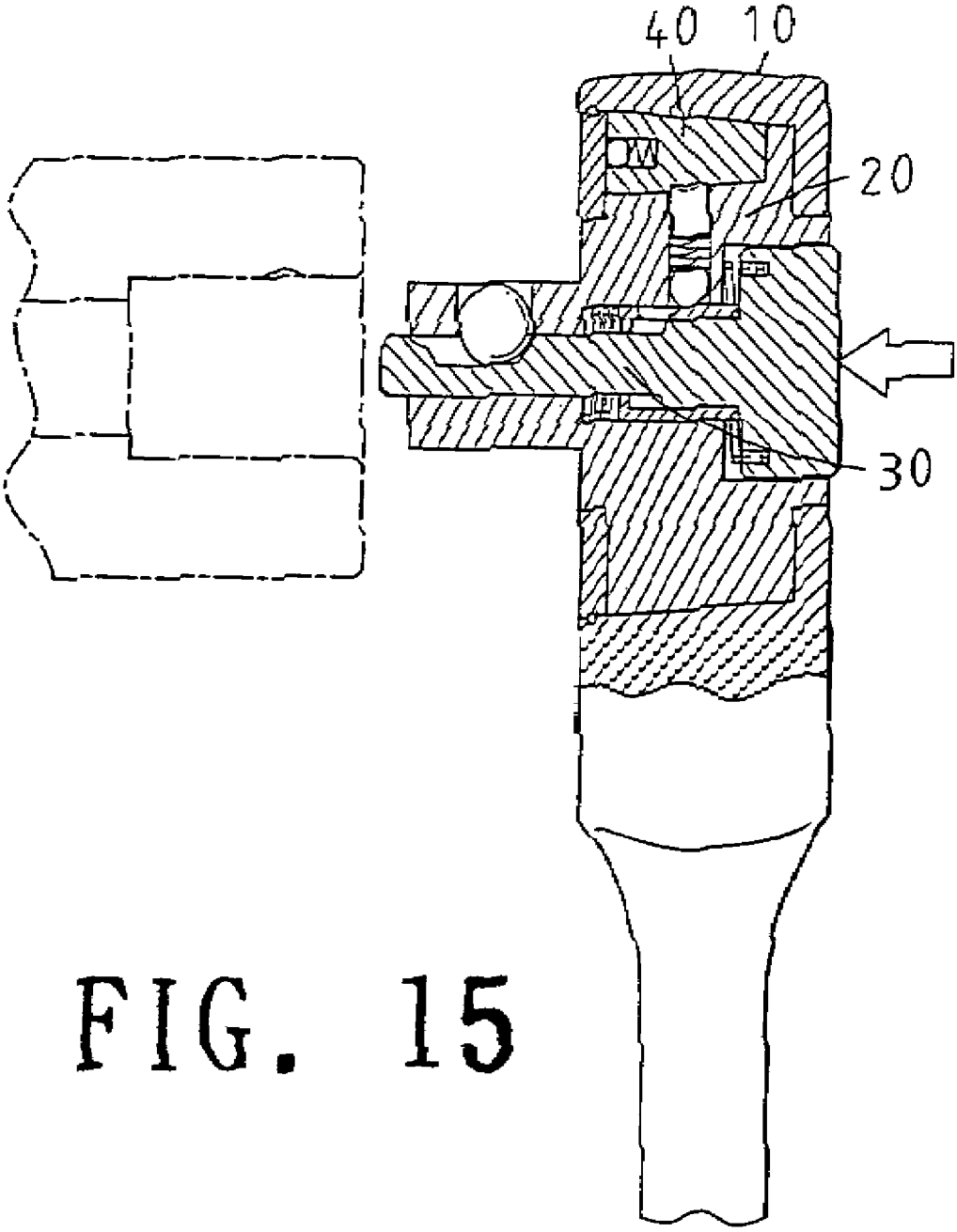
FIG. 15 is a schematic cross sectional view showing the switching operation in the second embodiment of the present invention.
Figure 16:
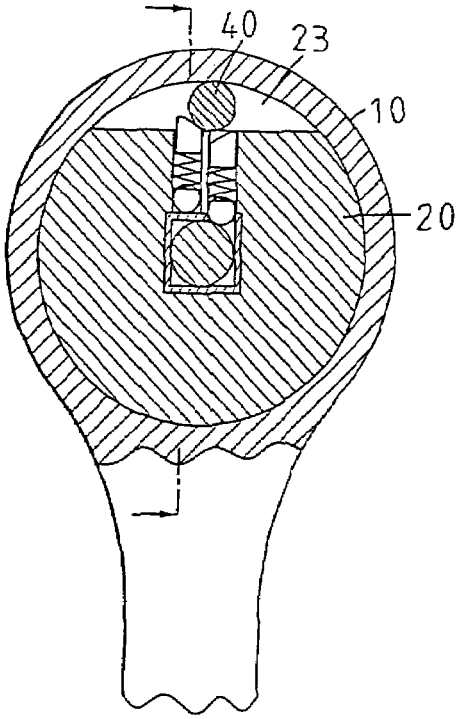
FIG. 16 is a cross sectional view about the returning operation in the second embodiment of the present invention.
Figure 17:
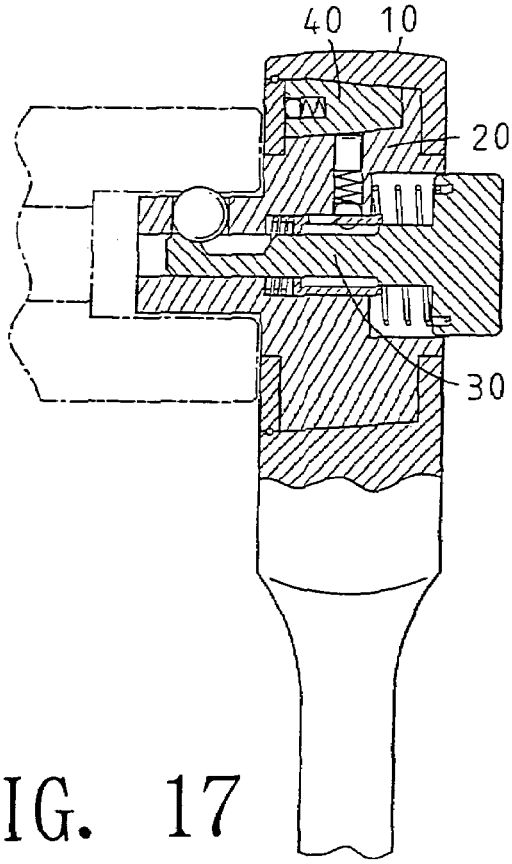
FIG. 17 is a cross sectional view along lie AB in FIG. 16.
Figure 18:
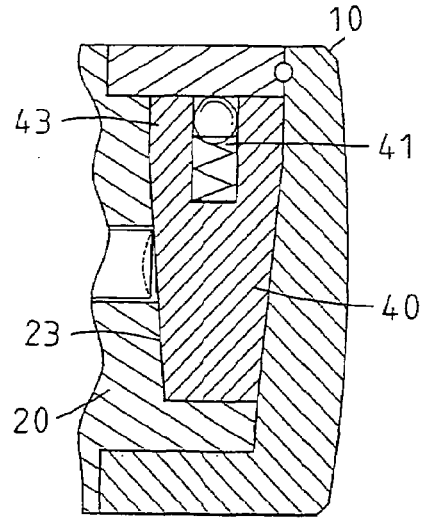
FIG. 18 is a cross section view showing the normal state of the ejection unit and buckling space of the present invention.
Figure 19:
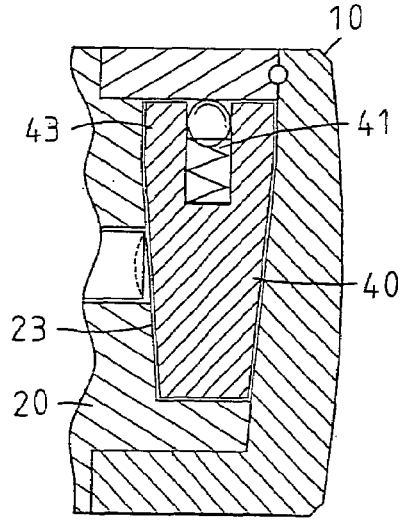
FIG. 19 is a schematic cross section view showing the wearing between the ejection unit and the buckling space so as to generate a gap therebetween.
Figure 20:
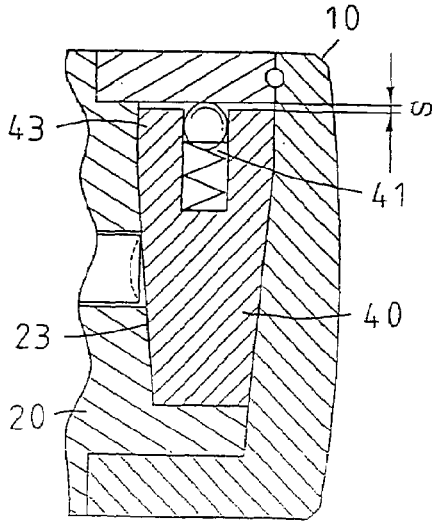
FIG. 20 is a cross section view of the ejection unit and the buckling space after correction.

Referring to FIGS. 13, 15 and 16, as the ejecting unit 40 is added with the positioning portion 43, not only having a positioning effect, but also the buckling and switching effects are achieved as those in the first embodiment. Thereby as shown in FIGS. 18 to 20, the present invention has the effect of calibration after wearing.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A returning assembly of a spanner comprising:

a driving portion having a receiving space for receiving a driving head and an ejecting unit; and the ejecting unit having a truncated conic shape; the ejecting unit having a receiving chamber and a resisting unit being positioned in the receiving chamber; and the driving head having an inclined buckling surface; the buckling surface and an inner wall of the receiving space being formed with a semilunar buckling space for receiving the ejecting unit; the ejecting unit serving for controlling the returning directions of the driving head; and wherein by the resisting unit can cause the ejecting unit to be firmly secured in the buckling space.

2. The returning assembly of a spanner as claimed in claim 1, wherein the resisting unit is formed of a steel ball and a spring.

3. The returning assembly of a spanner as claimed in claim 1, wherein a round cylindrical positioning portion is extended from the larger end of the truncated conic ejecting unit; and the buckling space has a shape corresponding to that of the ejecting unit.

4. The returning assembly of a spanner as claimed in claim 2, wherein a round cylindrical positioning portion is extended from the larger end of the truncated conic ejecting unit; and the buckling space has a shape corresponding to that of the ejecting unit.

5. The returning assembly of a spanner as claimed in claim 1, wherein the driving head is formed of an outer cover and a ring which are received in the receiving space of the driving portion; the driving head has a driving block which are arranged at an axial direction of the driving head for installing a socket or other driving assembly.

6. The returning assembly of a spanner as claimed in claim 2, wherein the driving head is formed of an outer cover and a ring which are received in the receiving space of the driving portion; the driving head has a driving block which are arranged at an axial direction of the driving head for installing a socket or other driving assembly.

7. The returning assembly of a spanner as claimed in claim 1, wherein a switch unit is installed in the driving head; the switch unit has a control end projected from the driving portion and a resisting end in the driving portion; the action of the resisting end is controlled by the operation of the control end; the resisting end of the switch unit resists against the ejecting unit in the buckling space; the shift of the ejecting unit is controlled by the control end so as to operate the resisting end to control the returning operation of the driving head.

8. The returning assembly of a spanner as claimed in claim 2, wherein a switch unit is installed in the driving head; the switch unit has a control end projected from the driving portion and a resisting end in the driving portion; the action of the resisting end is controlled by the operation of the control end; the resisting end of the switch unit resists against the ejecting unit in the buckling space; the shift of the ejecting unit is controlled by the control end so as to operate the resisting end to control the returning operation of the driving head.

* * * * *